United States Patent [19]

Plumadore

[11] 3,964,436

[45] June 22, 1976

[54] ELECTROPHOTOGRAPHIC DEVELOPMENT APPARATUS

[75] Inventor: John D. Plumadore, Westfield, Mass.

[73] Assignee: Scott Paper Company, Philadelphia, Pa.

[22] Filed: Apr. 8, 1974

[21] Appl. No.: 459,193

[52] U.S. Cl. ..... 118/637; 427/15; 118/DIG. 23

[51] Int. Cl.[2] ..... G03G 15/10

[58] Field of Search ..... 118/637; 117/17.5

[56] References Cited

UNITED STATES PATENTS

| | | | |
|---|---|---|---|
| 3,411,482 | 11/1968 | Brodie | 118/637 |
| 3,655,419 | 4/1972 | Tamai et al. | 118/637 |
| 3,683,852 | 8/1972 | Yamaguchi | 118/637 |
| 3,716,295 | 2/1973 | Nakajima et al. | 355/3 |
| 3,789,753 | 2/1974 | Rutherford | 118/637 |
| 3,898,957 | 8/1975 | Masumura | 118/637 |

*Primary Examiner*—Louis K. Rimbrodt
*Attorney, Agent, or Firm*—R. Duke Vickrey; John W. Kane, Jr.

[57] ABSTRACT

Disclosed is an apparatus for developing an electrostatic latent image on a frame of a multi-frame electrophotograhic film by placement of the film parallel to a closely spaced electrically floating development electrode which has a special size relationship to the charged frame area and by application of electrostatically charged toner particles between the electrode and the film. The development electrode is limited in size to have a potential induced upon it by the charge film which is between the highest and lowest potential charge on the imaged frame. In its peferred use, the development electrode is no greater in size than 10 percent larger than the charged frame area being developed, and preferably does not extend laterally beyond the frame.

3 Claims, 4 Drawing Figures

ELECTROPHOTOGRAPHIC DEVELOPMENT APPARATUS

BACKGROUND OF THE INVENTION

1. Field of the Invention

The invention relates generally to development of latent electrostatic images on electrophotographic films, and particularly, to a method and apparatus which provides good image development for microfiche film over a wide latitude of exposure conditions and film sensitivity ranges.

2. Description of the Prior Art

In electrophotography, it is common to apply a uniform electrostatic charge to the surface of the photoconductive layer of a film. The charge is then selectively dissipated in a pattern by exposing the surface to a light image. The resulting pattern of charges produces an electrostatic latent image on the photoconductive layer, which is then rendered visible by applying thereto electrostatically charged developer particles which adhere to the surface of the photoconductive layer by electrostatic forces. A permanent visible image can be obtained, for example, by using developer particles which can be heat fused to the photoconductive layer, and subjecting them to a heat application step.

A major difficulty in prior art systems is that, to produce a visible image of sufficient intensity, undesirable light and dark areas are sometimes present due to distortion of the electric lines of force at the charge surface of the photoconductive layer. Prior efforts to reduce this effect have been through the use of a development electrode spaced from the surface of the film being developed and connected to a source of electric potential to provide a bias that affects the charged developer particles. Other efforts have employed the development electrode in an electrically floating mode.

Examples of prior art uses of development electrodes can be found in such patents as U.S. Pat. No. 3,249,088 to Ostensen, U.S. Pat. No. 3,611,982 to Coriele et al, and U.S. Pat. No. 3,655,419 to Tamai et al. The Ostensen patent discloses a developing tank unit for electrostatic printing. A carrier sheet or film is passed through the developing tank unit where charged pigment particles attach to the electrostatically charged film. Within the developing tank unit is an "intensifier member" in the form of a plate or a roller of conductive material which is electrically floating.

The Coriele et al. patent discloses a xerographic developing apparatus with three development electrodes along the path which the charged surface moves. The charge potential or magnitude on the various electrodes is varied (through complicated electrical circuitry in the preferred embodiments) to vary the concentration and positioning of the toner particles in the flow stream and to regulate the degree of development and cleaning obtained in each of the electroded regions.

The Tamai et al patent discloses an electrophotographic reversal developing process. The electrophotographic element is placed close to a floating development electrode in a container of electrostatically charged particles to induce on the electrode a potential which causes an electric field to occur at the image or information portions of the electrostatic latent image oppositely directed from that occurring at the background portions. Toner particles having a charge of the same polarity as that of the background portion are introduced between the development electrode and the electrophotographic element to develop the imaged portion.

While the development electrodes disclosed in these patents are beneficial for some uses, they are not entirely satisfactory for the type of developing which must take plce in a preferred type of microphotographic recording apparatus in which imaging and developing takes place automatically within a single apparatus. In this preferred form of microphotographic recording apparatus, data from successive documents is sequentially recorded on individual frames of a microfiche, and each frame is developed before imaging the next succeeding frame. Development is preferably accomplished by positioning the imaged frame against an opening in a developing chamber, and electrostatically charged toner particles are flowed through the developing chamber to contact the imaged frame.

In the preferred microphotographic recording apparatus, described above, there is need for flexibility in the developing process because of variations which occur in imaging-light intensity, variations in the degree of darkness of documents being copied, and variations in the properties of the photoconductors used in the process. All of these factors can result in the electrostatic charge potentials which remain on the film after imaging being higher or lower place desired, which in turn affects the attractive forces upon the toner particles during development. Of particular importance is the difference between the highest and lowest charge potential on the imaged film. Where this difference is very slight, there is a tendency to produce dark, or unclean, background areas in the image. Additionally, where the lowest charge potential on the imaged film is greater in magnitude than zero, there is a tendency for the toner particles to also deposit in the areas having that lowest charge potential. In the preferred type of microphotographic recording apparatus, the background of the documents being copied usually correspond to the lowest charge potential on the film, and that area on the film is seldom discharged to zero, due to photoconductor properties and/or practical limitations on imaging-light duration and intensity.

The use of development electrodes could be helpful in giving flexibility to the electrostatic development process and solving some of the above-described problems, but none of the prior art development electrodes are entirely satisfactory for use in the preferred microphotographic recording apparatus, nor were they used in the same manner. For example, the apparatus of Ostensen and of Tamai et al. have development electrodes which are submerged in a reservoir of developing particles along with the charged film for development. Furthermore, the apparatus of Ostensen, like the apparatus of Coriele et al, passes the charged film or plate through a developing station when developing, while in Tamai et al., the charged film remains stationary along with the developing particles within the reservoir. Probably the biggest difference in the use of these prior art development electrodes from any proposed use in the preferred apparatus is that they were designed to develop an entire film or member at one time, whereas only a single frame on a larger microfiche is developed at one time in the preferred microphotographic recording apparatus.

Particular problems occur when using development electrodes to develop images smaller than the entire film, particularly if the electrode is electrically floating. Those problems are due to the effect on the electrode of that portion of the microfiche beyond the charged frame area being developed, and thus were not recognized in the prior art. The development electrode, being a flat plate closely spaced from the electrophotographic element, forms a capacitor not only with the portion of the electrophotographic element which was charged and is being developed, but also with the surrounding portions of the electrophotographic element, which has an adverse effect on the development electrode to be explained below. Biased development electrodes such as the type described in the Coriele et al patent, which are biased through complex electrical circuitry, could overcome this effect, but the use of complex electrical circuitry is undesirable from a cost standpoint and also because of size limitations in the preferred type of apparatus.

In recognition of the disadvantages of the prior art, it is an object of the invention to provide a method and apparatus for developing electrostatic latent images on individual frames of a multi-frame microfiche in a manner which is simple and permits flexibility.

SUMMARY OF THE INVENTION

These and other objects are accomplished through use of a special size development electrode which is electrically floating and positioned parallel to and close to the frame of the microfiche being developed during application of toner particles to the frame. The development electrode is limited in size to have induced upon it an electrostatic potential between the highest and lowest charge potential on the imaged frame, whereby the toner particles, which in the preferred form of the invention have an electrostatic charge opposite in polarity to the charge potential on the imaged frame, are attracted to the areas on the frame of highest charge potential and away from the areas on the frame of lowest charge potential. Thus, in recording the typical printed or typed document having a white background, the background, which will be the lowest charged area on the imaged frame, will be free from deposition of toner particles.

The apparatus of the invention is designed for developing an electrostatic latent image on a frame of a larger multi-frame electrophotographic film wherein the photoconductive layer of the film is not discharged to zero in any part of the imaged frame, and the apparatus includes an electrically floating development electrode positioned close to and parallel to the frame being developed and means for providing electrostatically charged toner particles between the development electrode and the frame being developed. The development electrode is no greater than 10 percent larger in area than the charged frame area being developed, and in the preferred embodiment, has no part extending laterally beyond the charged frame area being developed. Also, in the preferred embodiment of the apparatus, the means for providing toner particles includes a development chamber having an opening formed by a mask against which the frame to be developed is placed and a passageway through which toner particles are passed to contact the imaged frame. The passageway communicates with the opening and has the portion of the wall opposite the opening formed by the development electrode.

DESCRIPTION OF THE PREFERRED EMBODIMENT OF THE INVENTION

Figure 1:
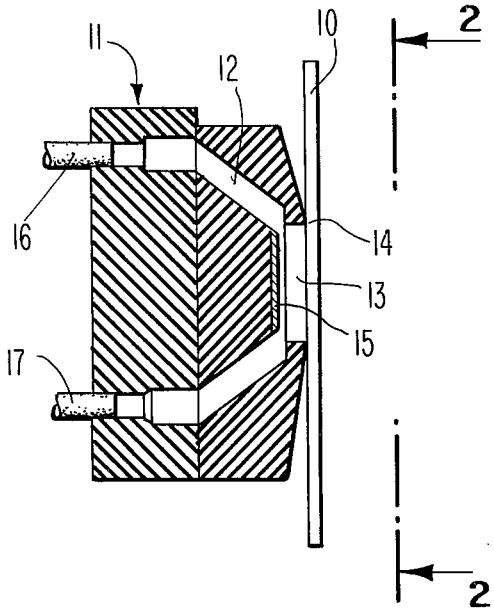
FIG. 1 is a cross sectional view of the developing chamber in which the present invention is employed, with a microfiche positioned for development.

After electrostatically charging a frame on an electrophotographic film 10 and imaging the frame to produce an electrostatic latent image, the frame is placed against an opening 13 in a developing chamber 11, illustrated in FIG. 1, for developing the image. The developing chamber 11 consists of a passageway 12 between inlet port 16 and outlet port 17. The walls of the passageway 12 include a mask 14, forming in the passageway 12 a rectangular opening 13 against which the frame to be developed on the film 10, which is preferably provided by a microfiche, is placed. The size of the opening 13 corresponds to the size of the frame being developed.

Electrostatically charged toner particles are drawn from a suitable supply reservoir through inlet port 16, through the passageway 12 and across the face of the frame of the microfiche 10 being developed, and out of the developing chamber 11 through outlet port 17. The toner particles are drawn through the developing chamber 11 preferably by a vacuum to preclude leakage of the toner particles and their carrier fluid from the seal formed by the mask 14 against the microfiche 10. Although it is desirable to place the development electrode 15 very close to the microfiche 10, the electrode should be spaced far enough away to permit flow of toner particles to the frame being developed. On the other hand, if the electrode 15 is too far away from the microfiche 10, for example more than one-half of the smallest dimension of the frame, it does not satisfactorily perform.

The developing chamber 11 is preferably constructed of a suitable electrically insulating material, with the exception of a development electrode 15, which forms part of the passageway 12 wall opposite to and close to the opening 13. The development electrode 15 is constructed of a thin sheet of electrically conductive material, such as copper, and aids in controlling deposition of toner particles onto the imaged area of the microfiche 10 in a manner to be described below.

Figure 2:
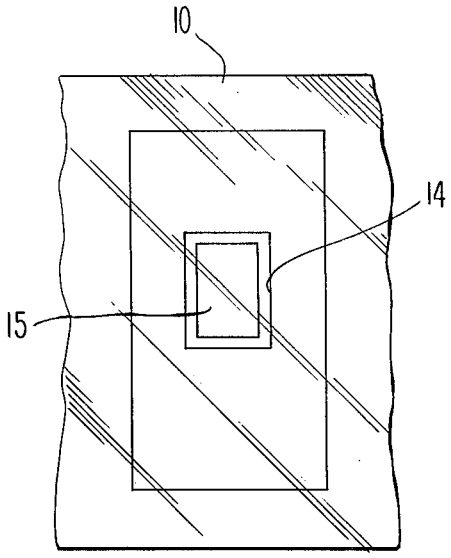
FIG. 2 is a view of the developing chamber illustrated in FIG. 1, taken along line 2—2.

FIG. 2 illustrates the developing chamber 11 as viewed from the right of transparent microfiche 10 positioned against it in FIG. 1. In FIG. 2, it can be seen that the development electrode 15, which is the preferred form of the electrode 15, is the same shape as the edges of mask 14 (which correspond to the edges of the frame being developed) and slightly smaller. No part of the development electrode 15 in this view extends laterally beyond the frame being developed. Use of a development electrode so positioned and sized has been found very beneficial for producing good images with wide variations in film and exposure conditions. All of this is accomplished by the development electrode being in an electrically floating mode and without use of complicated electric field measuring and external biasing apparatus.

Before explaining the operation of the development electrode of the invention, it should be understood that the preferred use of the invention is in a microphotographic recording apparatus which sequentially records information from documents upon individual frames of a multi-frame microfiche. The principle use of this type of apparatus is for recording written or typed information, of which a typical document has only about 10 percent or less of its area covered with dark information (typed letters or print, etc.) and about 90 percent is background, which is usually white. In such an arrangement, the frame of the microfiche about to be imaged is electrostatically charged to a generally uniform charge potential across the entire surface of the frame. The light image of the document is directed onto the photoconductive layer of the frame, and those portions of the frame corresponding to the portions of the document image which are white (or other background color) will be partially discharged through light decay. At the same time, the portions of the image on the frame which correspond to the dark letters or other information from the document will be subjected to little or at least much less discharge of their electrostatic charge potential. (They will have the highest charge potential on the imaged frame.)

Figure 3:
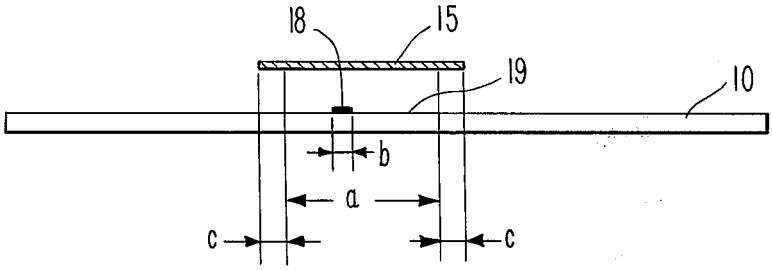
FIGS. 3 and 4 are diagrammatic views illustrating the function of the development electrode of the invention.
Figure 4:
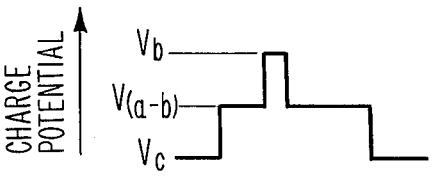

To illustrate the above statements, reference is made to FIGS. 3 and 4 where the charged area of a single frame on the microfiche 10 is illustrated by the dimension *a*. The least discharged portion of the frame which corresponds to the dark image information is indicated by the numeral 18 and the dimension *b*. The remaining background area of the charged frame, where the electrostatic charge potential has been discharged to the lowest charge potential is indicated by the numeral 19 and occupies the area (*a*—*b*). (Note that while only a single dimension is referred to in FIGS. 3 and 4, the dimension refers to area, as the other dimensions forming the area portions are to be considered all equal for convenience).

Referring to FIG. 4, the charge potentials at the various locations on the microfiche 10 after imaging are indicated as $V_b$ for the highest charge potential 18, $V_{(a-b)}$ for the lowest charge potential (background areas 19), and the charge potential of the remainder of the microfiche outside of the charged frame area being developed is indicated as $V_c$. In actual practice, the charge potential, $V_c$, of the remainder of the microfiche 10 outside of the charged frame area being developed will usually be zero volts since it was not charged during the imaging and developing of a particular frame.

The goal of the development electrode 15 is to form an electric field between the electrode 15 and the high charge potentials areas 18 which will cause the toner particles to be attracted to those areas 18 of the microfiche 10 and to form an electric field between the electrode 15 and the lowest charge potential areas 19 which will cause the toner particles to be attracted away from those areas 19 of the microfiche 10. If this goal is accomplished, the high charge potential area 18 will be darkly toned and the low charge potential or background areas 19 will be left clear. To accomplish this, the development electrode 15 should have an electrostatic potential somewhere between the charge potential of the greatest discharged areas 19 and the least discharged areas 18, or referring to FIG. 4, the development electrode 15 should have an electrostatic potential between $V_{(a-b)}$ and $V_{(b)}$.

Producing the desired electrostatic potential on the development electrode 15 is preferably accomplished through the potential induced upon the electrode 15 from the charged surface of the imaged frame when the electrode 15 is electrically floating and forms a capacitor between the microfiche 10 and itself. If the size of the development electrode 15 is properly chosen, an induced potential can be formed on the electrode 15 in an electrically floating mode which will have the desired electrostatic potential to accomplish the above-described goal over a wide lattitude of processing conditions. And the induced electrostatic potential will automatically vary to compensate for the variations in charge potentials occurring on the imaged frame without the necessity for complex electronic circuitry to determine the charge conditions on the film and to externally bias the development electrode to compensate for them.

An explanation of the importance of the size of the development electrode of the invention is as follows. The capacitor formed by the development electrode 15 and the microfiche 10 can be thought of in terms of a number of individual capacitors, each formed between a particular portion of the microfiche 10 and the corresponding portion of the development electrode 15. With such an arrangement, the following formula applies.

$$V_e C_e = V_b C_b + V_{(a-b)} C_{(a-b)} + V_c C_c + V_d C_d$$

where:

*V* refers to the induced voltage on the development electrode for a particular area, *C* refers to the capacitance formed by that portion of the electrode corresponding to the particular area, and the particular areas are defined by the following subscripts.

*e* = the entire development electrode;

*a* = the area corresponding to the imaged frame being developed;

*b* = the area corresponding to the highest potential charged areas 18 on the imaged frame;

(*a*—*b*) = the area corresponding to the lowest potential charged or background areas 19 of the frame;

*c* = the area of the development electrode which extends beyond the charged frame being developed;

*d* = the external influence on the development electrode from all sources other than the microfiche 10.

Since the development electrode 15 is positioned within a developing chamber 11 made from electrically insulating material, the external capacitance of the development electrode 15 due to all sources other than the microfiche 10 can be and is preferably made negligible and can be ignored in the formula. In most cases, the charge potential in all areas of the microfiche beyond the charged frame being developed (the area referred to as *c*) can be considered as zero volts. Furthermore, because the capacitance for any portion of the development electrode 15 is dependent upon the area of that portion (all other factors being considered as equal for convenience), the respective areas of particular portions of the microfiche can be substituted into the above formula in place of the corresponding capacitances. Thus, a simplified formula is as follows ("A" refers to area of a particular area):

$$V_e A_e = V_b A_b + V_{(a-b)} A_{(a-b)}$$

The formula can be further simplified for the microphotographic reproduction apparatus in which the present invention is preferably employed. For example, the dark area on the document which corresponds to the print or other information is usually about 10 percent of the total document area, and the light background area on the document is about 90 percent. Thus, it can be assumed that $A_b = 0.10\ A_a$ and $A_{(a-b)} = 0.90\ A_a$. Furthermore, in the preferred use of the invention, the charge potential, $V_{(a-b)}$, in the lowest charge potential or background areas 19, $A_{(a-b)}$, will be about 50 percent of the highest charge potential, $V_b$, and for design purposes should be assumed to be 50 percent thereof. Thus, it can be assumed that $V_b/V_{(a-b)} = V_b/0.50\ V_b = 2$.

Therefore, the formula reduces to:

$$\frac{V_e A_e}{V_{(a-b)}} = 2(.10\ A_a) + .90\ A_a$$

and since the electrostatic potential on the electrode, $V_e$, should be equal to or greater than the charge potential in the lowest charge potential or background area to obtain the benefits of the invention, or $V_e \geq V_{(a-b)}$, then:

$$A_e \leq 1.10\ A_a.$$

or the maximum development electrode size permitted is 110 percent of the area of the charged frame being developed.

While the above formula is useful in designing the development electrode 15 for use in any particular microfiche recording apparatus which records on a microfiche having a particular photoconductive material and in the preferred use of the invention, results in the development electrode being no greater than 10 percent larger than the image frame area being developed, it is preferable for the development electrode 15 to be no larger than the charged frame area being developed. One reason that the electrode 15 is preferably no larger than the charged frame area being developed (the embodiment illustrated in FIGS. 1 and 2), is that it is preferable for the electrostatic potential on the electrode 15, $V_e$, to be of slightly higher magnitude than the charge potential in the background area, $V_{(a-b)}$ to assure a clean background. Also, even though the background area on a microfiche might be discharged to 50 percent when the microfiche is fresh and the imaging apparatus is in perfect working order, older microfiche, weaker imaging light, or dirty imaging lens could reduce the amount of background discharge to less than 50 percent. In order to plan for such contingencies, the electrode 15 is preferably no larger than the charged frame area being developed, it being recognized that it is not convenient to alter the size of the development electrode for each recording operation.

It should be noted that the invention is designed for use in an electrophotographic recording apparatus wherein the lowest charge potentials on the imaged frame is more than zero, either of negative or positive potential as the invention contemplates charging the frame to either polarity. In the type of electrophotographic recording apparatus wherein the image background area of the electrophotographic element is discharged to zero, the size limitations of the invention are no longer as described herein as the lowest charge potential on the imaged frame is the same as the charge potential in the film area beyond the frame being developed.

It should also be noted that the electrostatic potential induced upon the development electrode 15 can be controlled to some extent by purposely changing the ratio of the least discharged areas, $A_b$, to the most discharged areas, $A_{(a-b)}$, in the charged frame area. This step is accomplished by forming a high charge region on the film which is outside of the document information recording area so that it does not interfere with the recorded document information, but is close enough to the recording area to increase the electrostatic potential induced upon the development electrode 15 so that the toner particles are more strongly attracted away from the lowest charge potential areas, $A_{(a-b)}$, in the recording area. The high charge region can be formed by imaging a dark border about the document information recording area, the part of the electrostatic latent image formed by the dark border preferably having a charge potential substantially equal to the highest charge potential, $V_b$, in the document information recording area. The dark border can be provided by a dark mask surrounding during imaging the document to be recorded.

What is claimed is:

1. An apparatus for developing an electrostatic latent image on a frame of a larger multi-frame electrophotographic film wherein the photoconductive layer of the film is not discharged to zero in any part of the imaged frame, the apparatus comprising an electrically floating development electrode positioned close to and parallel to the frame being developed and means for providing electrostatically charged toner particles between the development electrode and the frame being developed, the development electrode being no greater than 10% larger in area than the area of the charged frame being developed.

2. Apparatus according to claim 1, wherein no part of the development electrode extends laterally beyond the charged frame area being developed.

3. Apparatus according to claim 2, wherein the means for providing toner particles includes a development chamber having an opening formed by a mask against which the frame to be developed is placed and a passageway through which toner particles are passed to contact the frame, the passageway communicating with the opening and having a portion of the wall opposite the opening formed by the development electrode.

* * * * *

PO-1050
(5/69)

UNITED STATES PATENT OFFICE
CERTIFICATE OF CORRECTION

Patent No. 3,964,436 Dated June 22, 1976

Inventor(s) John D. Plumadore

It is certified that error appears in the above-identified patent and that said Letters Patent are hereby corrected as shown below:

Column 2, line 28, the word "place" should be --than--.

Signed and Sealed this

Fifth Day of October 1976

[SEAL]

*Attest:*

RUTH C. MASON
*Attesting Officer*

C. MARSHALL DANN
*Commissioner of Patents and Trademarks*